United States Patent [19]

Schiffer et al.

[11] Patent Number: 5,054,154

[45] Date of Patent: Oct. 8, 1991

[54] TOOTHBRUSH WITH FLEXIBLE HEAD

[75] Inventors: Carl Schiffer; Berthold Meyer, both of Neustadt/Wied, Fed. Rep. of Germany

[73] Assignee: M & C Schiffer GmbH, Fed. Rep. of Germany

[21] Appl. No.: 422,833

[22] Filed: Oct. 17, 1989

[30] Foreign Application Priority Data

Jul. 15, 1989 [DE] Fed. Rep. of Germany ..... 3923495

[51] Int. Cl.[5] ..... A46B 9/04

[52] U.S. Cl. ..... 15/167.1; 15/143 R; 15/172; D4/104; D4/138

[58] Field of Search ..... 15/167.1-167.3, 15/143 R, 106, 110, 186-188, 159 R, 160, 159 A, 144 R, 201, DIG. 5, 172; D4/104-113, 127-138, 199; D24/10, 11; 16/110 R; 81/489; 30/85; 401/6

[56] References Cited

U.S. PATENT DOCUMENTS

| | | | |
|---|---|---|---|
| 758,764 | 5/1904 | Macleod | 15/143 R X |
| 759,490 | 5/1904 | Yates | 15/143 R X |
| 1,369,966 | 3/1921 | Cosens et al. | 15/143 R X |
| 1,796,001 | 3/1931 | Church | 15/167.1 |
| 2,028,011 | 1/1936 | Raymond | 30/85 |
| 3,120,670 | 2/1964 | Amodeo | 15/167.1 |
| 4,520,526 | 6/1985 | Peters | 15/167.1 |
| 4,829,621 | 6/1989 | Phenegar | 15/144 R X |

FOREIGN PATENT DOCUMENTS

| | | | |
|---|---|---|---|
| 8803772 | 6/1988 | World Int. Prop. O. | 15/167.1 |
| 8806417 | 9/1988 | World Int. Prop. O. | 15/167.1 |

*Primary Examiner*—Philip R. Coe
*Assistant Examiner*—C. Cooley
*Attorney, Agent, or Firm*—Diller, Ramik & Wight

[57] ABSTRACT

A toothbrush formed of a handle, a neck and a bristle head. In order to allow the bristle head to move out of the way in the event of excessive brushing pressure being applied during toothbrushing, an elastic segment is provided between the handle and the bristle head. Injury to the gums, damage to the teeth and possibly to the tooth-holding means can be averted by the elastic flexure of the bristle head. The elastic segment is formed by one or more clearances, slots or slits at least partially filled with elastic polymeric/copolymeric plastic material.

7 Claims, 2 Drawing Sheets

TOOTHBRUSH WITH FLEXIBLE HEAD

BACKGROUND OF THE INVENTION

The invention concerns a toothbrush with a handle, a neck, a bristle head, and an elastically flexible segment being provided between the handle and the bristle head.

The elastically flexible segment allows the bristle head to deflect or move out of the way when brushing one's teeth, particularly in the event of excessive compression. The purpose of such elastic deflection of the bristle head is to prevent injury to the gums, teeth, bridges and other tooth fasteners, particularly in the event of excessive compression.

DESCRIPTION OF RELATED ART

As regards a previously known toothbrush with an elastic segment, this segment is formed by tightly adjacent coils which are connected to each other by a core. The entire elastic segment including the coils is made of the same plastic as the basic unit consisting of the handle, neck and bristle head. Ordinarily a semi-rigid plastic is used, and therefore the plastic segment is not generally satisfactory. Another drawback is the difficulty or impossibility of cleaning toothpaste penetrating between the coils of the segment.

In another conventional toothbrush, an elastic metal strip is inserted in the segment between the handle and the bristle head of the segment. However, this toothbrush involves serious manufacturing difficulties.

SUMMARY OF THE INVENTION

Accordingly, it is an object of the present invention to provide a toothbrush which is easily manufactured, the elastic segment thereof can be adjusted precisely to the size required for manufacturing, and the toothbrush is free of cleaning problems.

In keeping with the present invention, the elastic segment comprises one or more clearances, gaps, slots or grooves whereby one or more elastic bridges are formed between the bristle head and handle, and the clearances are provided with elastic, compressible or expansible rubbery plastic material.

With the above and other objects in view that will hereinafter appear, the nature of the invention will be more clearly understood by reference to the followig detailed description, the appended claims and the several views illustrated in the accompanying drawings.

DESCRIPTION OF THE PREFERRED EMBODIMENTS

Figure 1:
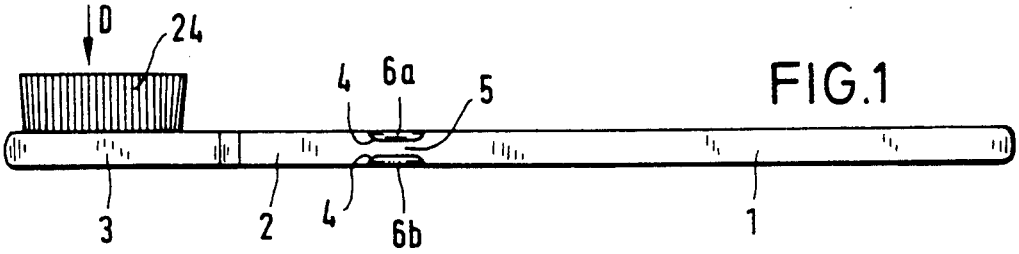
FIG. 1 is a sideview of a toothbrush constructed in accordance with the invention.
Figure 2:
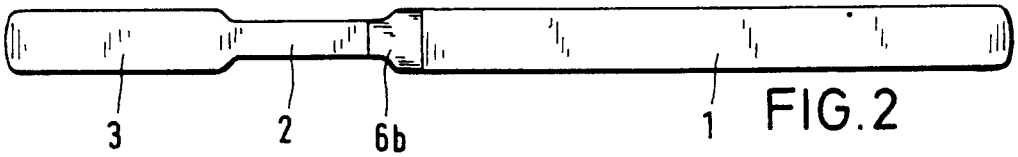
FIG. 2 is a plan view of the underside of the toothbrush of FIG. 1.

A toothbrush of FIGS. 1 and 2 comprises a handle 1, a neck 2 and a bristle head 3. The handle, neck 2 and bristle head 3 form the basic body of the toothbrush and are made of a single piece of conventional semi-rigid plastic material. Bristles 24 are conventionally fixed to the bristle head 3 in this and the remaining illustrated toothbrushes. The toothbrush of FIGS. 1 and 2 comprises in a region between the handle 1 and the neck 2 an elastic, flexible zone, portion or segment which is created during the manufacturing process by clearances, slots or grooves 4 provided both at the top and at the bottom side whereby a central thin bridge 5 is formed. The clearances 4 each are filled by plastic material 6*a* and 6*b* consisting of a very elastic, rubbery material, preferably of polymers. The filling of the clearance 4 with a rubbery plastic takes place in a second manufacturing stage after the basic body is manufactured in a first stage.

If now the toothbrush is loaded in the direction of the arrow D during tooth brushing, the rubbery plastic 6*a* at the topside of the toothbrush of FIG. 1 is stressed in tension and the plastic 6*b* on the bottom side is stressed in compression. This principle also applies in the remaining illustrative embodiments of the invention described hereinafter.

The thickness and the shape of the bridge 5 and the size and shape of the clearances 4 and the various elasticities of the rubbery plastic 6*a*, 6*b* filling the clearances 4 may be varied in such a manner in manufacture that the desired individual elasticity shall be present in the final product.

Figure 3:
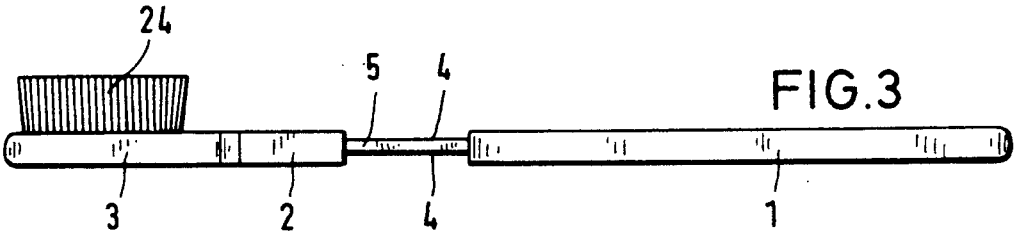
FIG. 3 is a side view of another embodiment of a toothbrush after the performance of the first manufacturing step.
Figure 4:
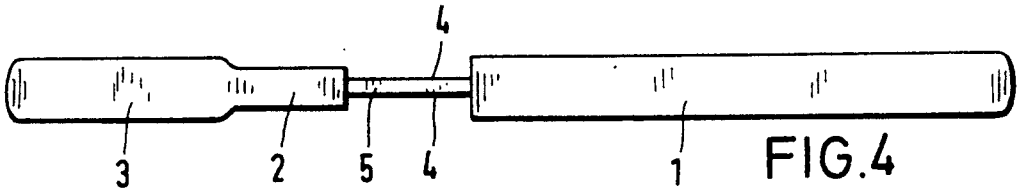
FIG. 4 is a plan view of the underside of the toothbrush of FIG. 3.
Figure 5:
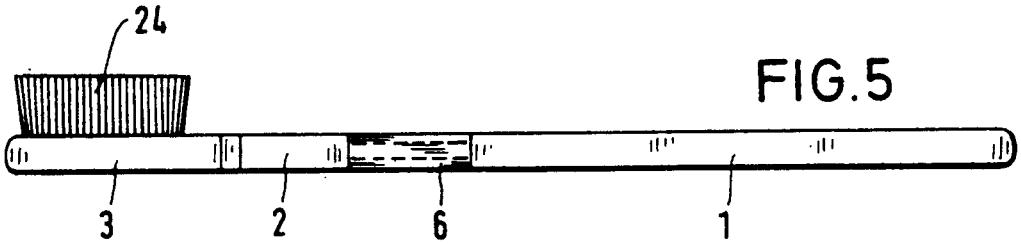
FIG. 5 is a side view of the toothbrush corresponding to FIG. 3, but illustrates the toothbrush after the second manufacturing step and ready for use.
Figure 6:
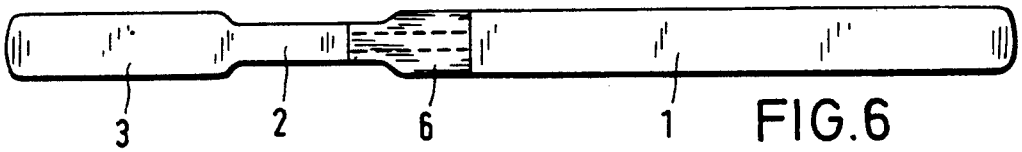
FIG. 6 is a plan view of the underside of the toothbrush of FIG. 5.

When compared to FIGS. 1 and 2, FIGS. 3 and 5 represent a similar embodiment of the basic toothbrush except that in the case of FIGS. 3 and 4 the clearances 4 are provided in the form of constrictions, slots or grooves 4 on all four sides in the zone or segment between the handle 1 and the bristle head 3, whereby a central, longitudinal, narrow bridge 5 is formed which illustratively may be rectangular in cross-section. In association with FIGS. 3 and 4, FIGS. 5 and 6 show the finished toothbrush, following the second manufacturing stage, in which the bridge 5 is surrounded on all sides by the elastic plastic material or body 6.

Figure 7:
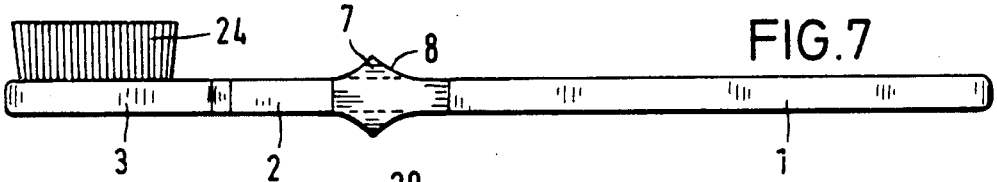
FIG. 7 is a side view of another toothbrush of the invention.
Figure 8:
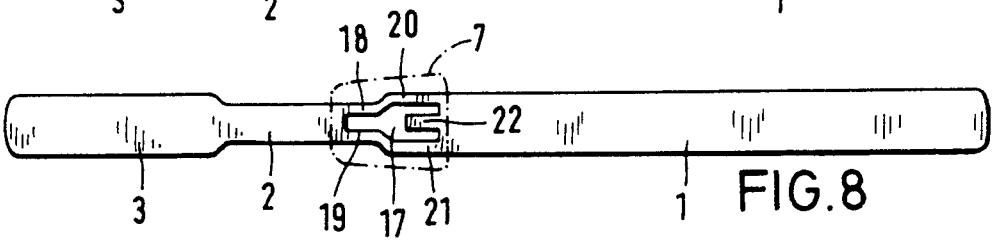
FIG. 8 is a plan view of the underside of the toothbrush of FIG. 7.

A Y-shaped clearance groove or slot 17 is provided in the toothbrush of FIGS. 7 and 8 to form the elastic segment between the handle 1 and bristle head 3. The Y-shaped clearance 17 forms bridges 18, 20 and 19, 21 on opposite sides of the Y-shaped clearance 17. A tongue 22 projects into the Y-shaped clearance 17. The Y-shaped clearance 17 is filled with an elastic plastic body or material which, as shown in FIG. 7, forms a bulge 7. The bulge 7 extends both on the topside and underside of the toothbrush and preferably is contoured to provide a concave thumb rest 8 (FIG. 7).

Figure 9:
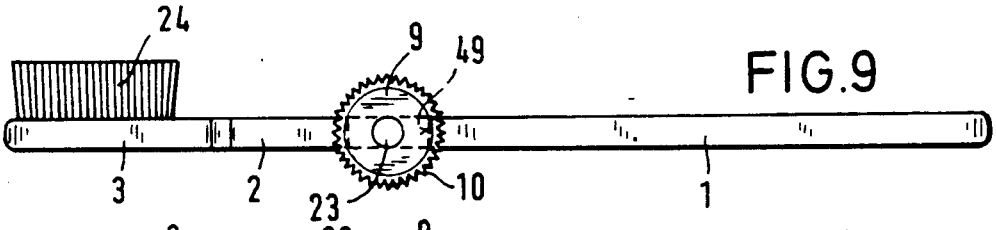
FIG. 9 is a side view of another toothbrush of the invention.
Figure 10:
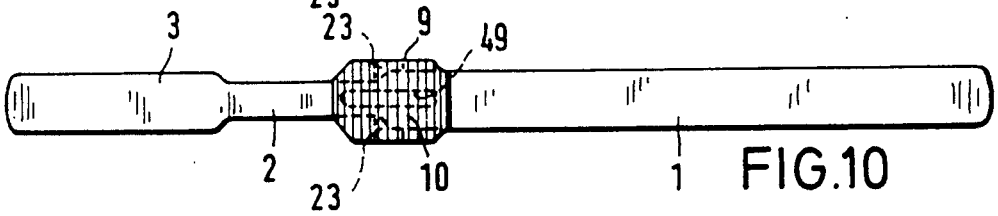
FIG. 10 is a plan view of the underside of the toothbrush of FIG. 9.

The toothbrush of FIGS. 9 and 10 also comprises a clearance in the form of an elastic segment or a slot 49 between the handle and the bristle head 3 in the manner described above. The elastic plastic material or body 9 in this embodiment is essentially cylindrical and acts like a hinge. Moreover, lateral hinge studs 23 may be provided. To form an actual hinge means in the toothbrush that is between the handle 1 on one hand and the neck 2 on the other, the toothbrush is preferably made of two parts which then would articulate or hinge relative to each other by means of the actual hinge and the elastic material or body 9. However, such an actual articulation or hinge means is recommended only very rarely because of the higher cost of manufacture involved. It is furthermore preferably that the plastic body 9 comprise an external cross-fluting or cross-grooving 10. However, the plastic body 9 also may be made formed accordion-like circumferentially or longitudinally.

Figure 11:
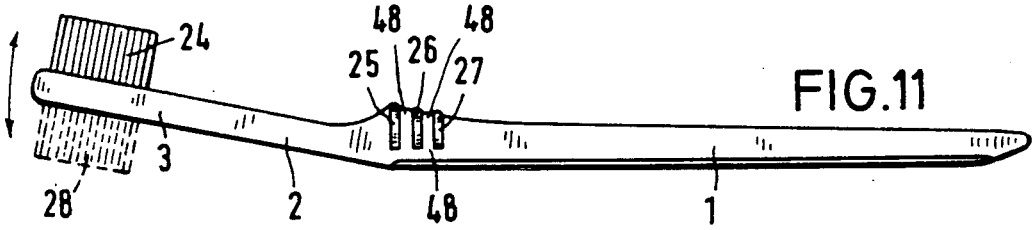
FIG. 11 is a side view of another toothbrush of the invention.
Figure 12:
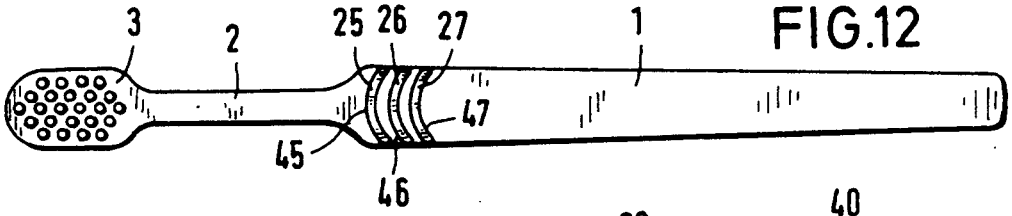
FIG. 12 is a top view of the toothbrush of FIG. 11.

FIGS. 11 and 12 show a further toothbrush of the invention wherein the clearances are cross-slits or cross-slots 45, 46 and 47. As shown in particular by FIG. 12, these cross-slits 45, 46 and 47 are located in the segment between the handle 1 and the neck 2 and are of such depths that three small external bridges 48 remain which contirubute to the elasticity of the segment. Again, the cross-slits are filled with elastic plastic material 25, 26 and 27. To provide a thumb rest, the plastic material or bodies 25, 26 and 27 also may project somewhat from the basic body in the upward direction, as shown in FIG. 11. As in all the other toothbrushes, the elastic plastic bodies 25, 26 and 27 are firmly joined to the walls of the clearances 45, 46 and 47 of the particular basic toothbrush body. If now bristles 24 (shown in solid lines in FIG. 11) are mounted on the topside of the bristle head 3, then the plastic bodies 25, 26 and 27 are stressed in tension when the toothbrush is used and will stretch more or less in accordance with the applied force. If on the other hand the bristles 28, indicated by phantom lines in FIG. 11 are on the underside of the bristle head 3, then the plastic bodies 25, 26 and 27 are stressed compressively when the toothbrush is being used.

Figure 13:
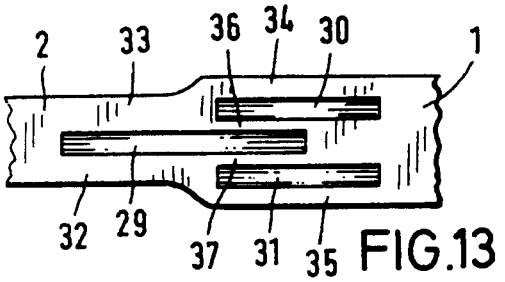
FIG. 13 is a fragmentary top view of a plurality of clearances or slots of an elastic segment of another toothbrush of the invention.

FIG. 13 shows another embodiment of an elastic segment in the form of clearances in a toothbrush. In this case three clearances (unnumbered) are present in the form of offset longitudinal slots whereby outer longitudinal bridges 32, 33 and 34, 35 and inner longitudinal bridges 36 and 37 are formed. The longitudinal slots (unnumbered) are filled with elastic plastic material 29, 30 and 31. FIG. 13 merely indicates one embodiment of many wherein in general several briges may be provided at the longitudinal sides and/or at the topside and underside of the basic toothbrush body in the segment between the handle 1 and the neck 2.

Figure 14:
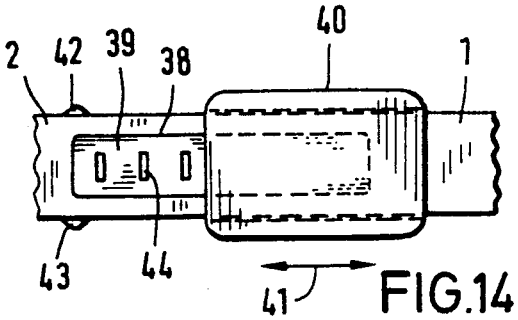
FIG. 14 is a top view of another elastic segment of another toothbrush of the invention.

Lastly, FIG. 14 shows another embodiment of the invention in which an elastic segment can be set to a desired elasticity individually and selectively by the person using the toothbrush. A longitudinally displaceable slide means 40 is the form of a sleeve used of this purpopse, and can be selectively slipped more or less over the clearance or slot 38 and the elastic plastic body or material 39 therein in the direction of the arrow 41. Appropriately the slide means or sleeve 40 comprises a semi-rigid plastic corresponding to that of the basic toothbrush body. Stops 42, and possibly further stops 43, as well indents 44, may be provided for the slide means 40, and said stops 42, 43 and indents 44 may be designed and mounted in numerous known ways.

Although a preferred embodiment of the invention has been specifically illustrated and described herein, it is to be understood that minor variations may be made in the apparatus without departing for the spirit and scope of the invention as defined in the appended claims.

We claim:

1. A toothbrush comprising a handle, a neck, a bristle head and bristles projecting generally transversely from said bristle head in a direction away from one side of said handle; said handle, neck and bristle head include a generally longitudinal axis, means for forming an elastic segment between said handle and said bristle head, said elastic segment forming means includes at least one slit disposed in generally transverse relationship to said longitudinal axis and open in a direction transversely away from said longitudinal axis, elastic material in said at least one slit, and said elastic material extends above an outer surface of said handle forming an area for a user's thumb to rest.

2. The toothbrush as defined in claim 1 wherein said at least one slit is of an arcuate configuration.

3. The toothbrush as defined in claimed 1, wherein said at least one slit is of an arcuate configuration opening in a direction away from said bristle head.

4. A toothbrush comprising a handle, a neck, a bristle head and bristles projecting generally transversely from said bristle head in a direction away from one side of said handle; said handle, neck and bristle head include a generally logitudianl axis, means for forming an elastic segment between said handle and said bristle head, said elastic segment forming means includes at least one slit disposed in generally tranverse relationship to said longitudinal axis and opening in a direction transversely away from said longitudinal axis, elastic material in said at least one slit, said at least one slit is of an arcuate configuration, and said elastic material extends above an outer surface of said handle forming an area for a user's thumb to rest.

5. A toothbrush comprising a handle, a neck, a bristle head and bristles projecting generally transversely for said bristle head in a direction away from one side of said handle; said handle, neck and bristle head include a generally longitudinal axis, means for forming an elastic segment between said handle and said bristle head, said elastic segment forming means includes at least one slit disposed in generally transverse relationship to said longitudinal axis and opening in a direction transversely away from said longitudinal axis, elastic material in said at least one slit, at least one further slit disposed adjacent to said first-mentioned at least one slit, elastic material in said at least one further slit, and the elastic material in said at least one and further slits protrudes above an outer surface of said handle forming an area for a user's thumb to rest.

6. A toothbrush comprising a handle, a neck, a bristle head and bristles projecting generally transversely from said bristle head in a direction away from one side of said handle; said handle, neck and bristle head include a generally longitudinal axis, means for forming an elastic segment between said handle and said bristle head, said elastic segment forming means includes at least one slit disposed in generally transverse relationship to said longitudinal axis and opening in a direction transversely away from said longitudinal axis, elastic material in said at least one slit, at least one further slit disposed adjacent to said first-mentioned at least one slit, elastic material in said at least one further slit, the elastic material in said at least one and further slits protrudes above an outer surface of said handle forming an area for a user's thumb to rest, and said at least one and further slits open in the same direction as the direction of projection of said bristles from said handle one side.

7. A toothbrush comprising a handle, a neck, a bristle head and bristles projecting generally transversely from said bristle head in a direction away from one side of said handle; said handle, neck and bristle head including a generally longitudinal axis, means for forming an elastic segment between said handle and said bristle head; said elastic segment forming means including a plurality of curved slits spaced from each other, said plurality of curved slits being disposed in generally transverse relationship to said longitudinal axis and opening in a direction transversely away from said longitudinal axis, and elastic material in said curved slits.

* * * * *